US006963165B2

(12) United States Patent
Park et al.

(10) Patent No.: US 6,963,165 B2
(45) Date of Patent: Nov. 8, 2005

(54) FIELD EMISSION DISPLAY HAVING INTEGRATED GETTER ARRANGEMENT

(75) Inventors: Nam-sin Park, Kyungki-do (KR); Sung-hwan Jin, Seoul (KR); Hyun-ji Lee, Kyungki-do (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/353,991

(22) Filed: Jan. 30, 2003

(65) Prior Publication Data

US 2003/0160561 A1 Aug. 28, 2003

(30) Foreign Application Priority Data

Jan. 30, 2002 (KR) ..... 2002-5366

(51) Int. Cl.[7] ..... H01J 7/18; H01J 1/02

(52) U.S. Cl. ..... 313/495; 313/493; 313/497; 313/553; 313/558; 313/559

(58) Field of Search ..... 313/495, 493, 313/496, 497, 553, 558, 559, 309, 422

(56) References Cited

U.S. PATENT DOCUMENTS 5,453,659 A 9/1995 Wallace et al.
5,693,438 A 12/1997 Liu et al.
5,734,226 A * 3/1998 Cathey ..... 313/553
5,835,991 A * 11/1998 Niiyama et al. ..... 313/553
5,849,442 A 12/1998 Liu et al.
5,866,978 A 2/1999 Jones et al.
5,894,193 A * 4/1999 Amrine et al. ..... 313/495
6,100,627 A * 8/2000 Carretti et al. ..... 313/309
6,127,777 A 10/2000 Watkins et al.

FOREIGN PATENT DOCUMENTS

EP 1 020 889 A1 7/2000
JP A-2001-210225 8/2001
WO WO 99/00822 A1 1/1999

* cited by examiner

*Primary Examiner*—Karabi Guharay
*Assistant Examiner*—Sikha Roy
(74) *Attorney, Agent, or Firm*—Buchanan Ingersoll PC

(57) ABSTRACT

A field emission display (FED) and a manufacturing method thereof are provided. The FED includes a getter portion isolated outwardly from an active display region. This getter portion includes a non-evaporable getter layer for absorbing gas and an electron emission source for activating the getter layer. Accordingly, by activating the non-evaporable getter, the gas generated in the display is easily absorbed, and the FED is maintained in a high vacuum state.

7 Claims, 5 Drawing Sheets

FIELD EMISSION DISPLAY HAVING INTEGRATED GETTER ARRANGEMENT

This application claims the priority from Korean Patent Application No. 2002-5366, filed on Jan. 30, 2002, in the United States Patent and Trademark Office, the disclosure of which are incorporated herein in its entirety by reference.

BACKGROUND OF THE INVENTION

1. Field of the Invention

The present invention relates to a field emission display (FED) and a manufacturing method thereof, and more particularly, to a field emission display (FED), which is maintained in a high vacuum state by absorbing gases in a display panel through the activation of a non-evaporable getter (NEG) layer that is formed on the front plate of the FED, and a manufacturing method thereof.

2. Description of the Related Art

In a field emission display (FED), several hundreds to thousands of micro tips or carbon nanotubes (CNTs) per pixel are provided as an electron emission source on a back plate of FED, and a phosphor layer emitting a light by an electron from the electron emission source is formed on a front plate of FED. A gap between the front plate and the back plate of FED is usually about 200 $\mu$m to several mms and the display must be maintained in a high vacuum state so that electrons are moved without energy loss.

A conventional display using electron emission includes a cathode ray tube (CRT) in a TV set. Since the internal volume of the CRT is very large, it is comparatively easy that the CRT is maintained in a vacuum state. However, in the case of the FED, the internal volume of the display is very small, and thus, it is very difficult that the FED is maintained in a vacuum state. This is the reason materials generating gases are relatively widely distributed in the small internal volume of the FED, and thus, vacuum state of FED may be rapidly deteriorated by the gases that is generated from the materials. Thus, the FED must be manufactured in a high vacuum state, and this vacuum state has a great effect on the quality and lifetime of the FED.

FIG. 1 is a schematic cross-sectional view of a conventional FED, and FIG. 2 is a schematic projected top-view of the conventional FED.

The conventional FED includes a front plate 10 and a back plate 20 that are spaced from one another by a gap. An anode 12 and a cathode 22 having a striped form are formed on the opposite inner surfaces of the front plate 10 and the back plate 20, respectively. A gate insulating layer 24 in which holes 24*a* are formed, is disposed on the cathode 22. A gate electrode 26 in which gates 26*a* corresponding to the holes 24*a* are formed, is formed on the gate insulating layer 24. An electron emission source 28 such as micro tip and carbon nanotube (CNT), is formed on the surface of the cathode 22 that is exposed at the bottom of the holes 24*a*.

A phosphor layer 14 having colors corresponding to pixels are coated on the anode 12, and a black matrix 16 for improving contrast and color purity is formed among the phosphor layer 14. A plurality of spacers 18 for maintaining the gap between the front plate 10 and the back plate 20 are positioned between the front plate 10 and the back plate 20, and a sidewall frame 30 for sealing a display panel is positioned at edges between the front plate 10 and the back plate 20.

An exhausting path 40 for exhausting an internal gas is formed at one side of the back plate 20, and a sealing cap 40*a* for sealing the outlet of the exhausting path 40 is formed at the outlet of the exhausting path 40. A gas path 42 through which the internal gas is flowed into is positioned at another side of the back plate 20, and a getter container 46 including a getter 44 for absorbing gases is connected to the end of the gas path 42.

In the FED having the above structure, the getter container 46 is protruded outwardly from the back plate 20, resulting in an increase in the total thickness of the panel including the getter container 46. Since the absorption of gas is made through the gas path 42 having a narrow section area with very large gas flow resistance, the effective absorption of the gas is difficult. The large gas flow resistance is caused from the narrow gap between the front plate 10 and the back plate 20 that are maintained at a 200 $\mu$m to several mms of interval as well as from the gas path 42. Due to the increase in gas flow resistance between the front plate 10 and the back plate 20, it is very difficult that an internal gas, in particular, a gas far from the gas path 42, is passed through the gap between the front plate 10 and the back plate 20 and the gas path 42. Accordingly, the internal gas cannot be effectively removed, and thereby there is a limitation in increasing internal vacuum level.

SUMMARY OF THE INVENTION

The present invention provides a field emission display (FED), which is capable of effectively removing residual internal gas, and a manufacturing method thereof.

The present invention further provides a field emission display (FED) which is capable of absorbing gas so that internal vacuum can be maintained when an internal gas is generated during the operation of the FED, and a manufacturing method thereof.

Accordingly, according to an aspect of the present invention, there is provided an improved field emission display (FED). The FED includes a front plate and a back plate spaced from one another by a gap, providing an active display region in an internal vacuum space formed therebetween, an electron-emitting portion being provided in the active display region on the back plate and including a cathode, an electron emission source being formed on the cathode, and a gate electrode for controlling electron emission, a light emission-displaying portion corresponding to the electron-emitting portion, being provided in the active display region on the front plate and including an anode corresponding to the cathode, and a phosphor layer from which light is emitted by electrons emitted from the electron-emitting portion; and a getter portion including an getter anode that is provided inside of the front plate or the back plate, a getter layer that is formed on the getter anode and absorbs gas through activation, a getter cathode that is positioned on the back plate or the front plate to face the getter anode, and a getter electron emission source that is formed on the getter cathode and emits electrons for activating the getter layer.

According to another aspect of the present invention, there is provided a method for manufacturing a field emission display (FED). The method includes the steps of (a) preparing a back plate on which a cathode, an electron emission source and a gate electrode for controlling an electron emission on the cathode are formed, in a predetermined active display region, (b) preparing a front plate on which an anode corresponding to the cathode and a phosphor layer from which light is emitted by electrons emitted from the electron emission source are formed, (c) sequentially forming a getter anode and a getter layer on an inner surface of the front plate or the back plate, (d) forming a getter cathode on an inner surface of the back plate or the front plate to face the getter anode, (e) forming the electron emission source on the getter cathode, (f) sealing the edges between the front plate and the back plate, exhausting gas and evacuating a space between the front plate and the back plate, and (g) activating the getter layer by applying voltage to the getter anode and the getter cathode so that gases generated in the space is absorbed.

BRIEF DESCRIPTION OF THE DRAWINGS

The above and other features and advantages of the present invention will become more apparent by describing in detail a preferred embodiment thereof with reference to the attached drawings in which.

DETAILED DESCRIPTION OF THE INVENTION

Hereinafter, the present invention will be described in detail by describing a preferred embodiment of the invention with reference to the accompanying drawings. The thickness of layers or regions shown in drawings is exaggerated for clarity.

Figure 1:
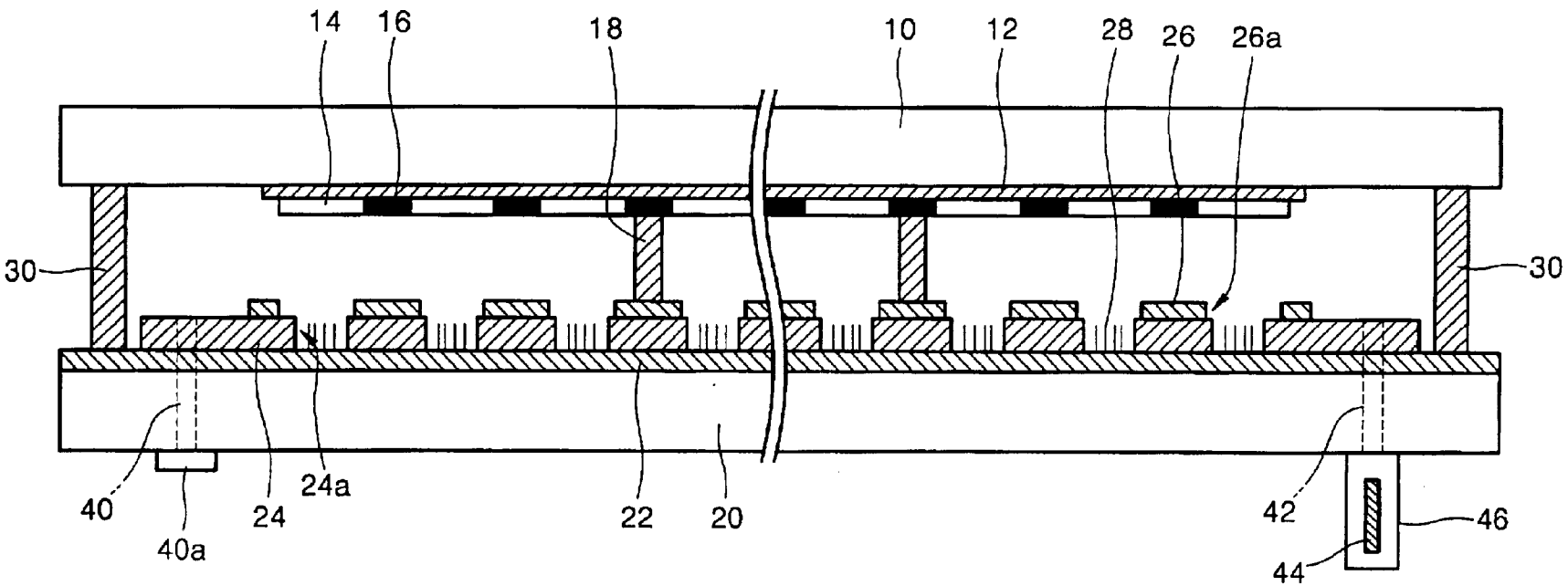
FIG. 1 (PRIOR ART)
FIG. 1 is a schematic cross-sectional view of a conventional field emission display (FED)
Figure 2:
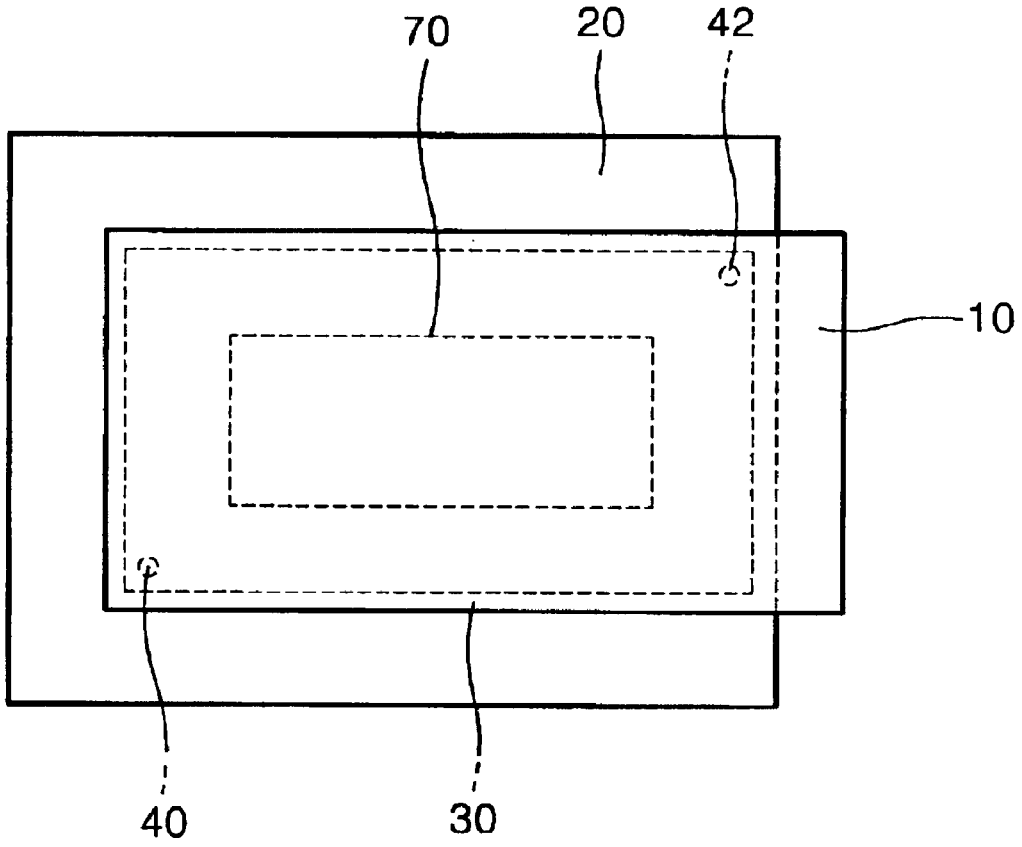
FIG. 2 (PRIOR ART)
FIG. 2 is a schematic projected top view of FIG. 1.
Figure 3:
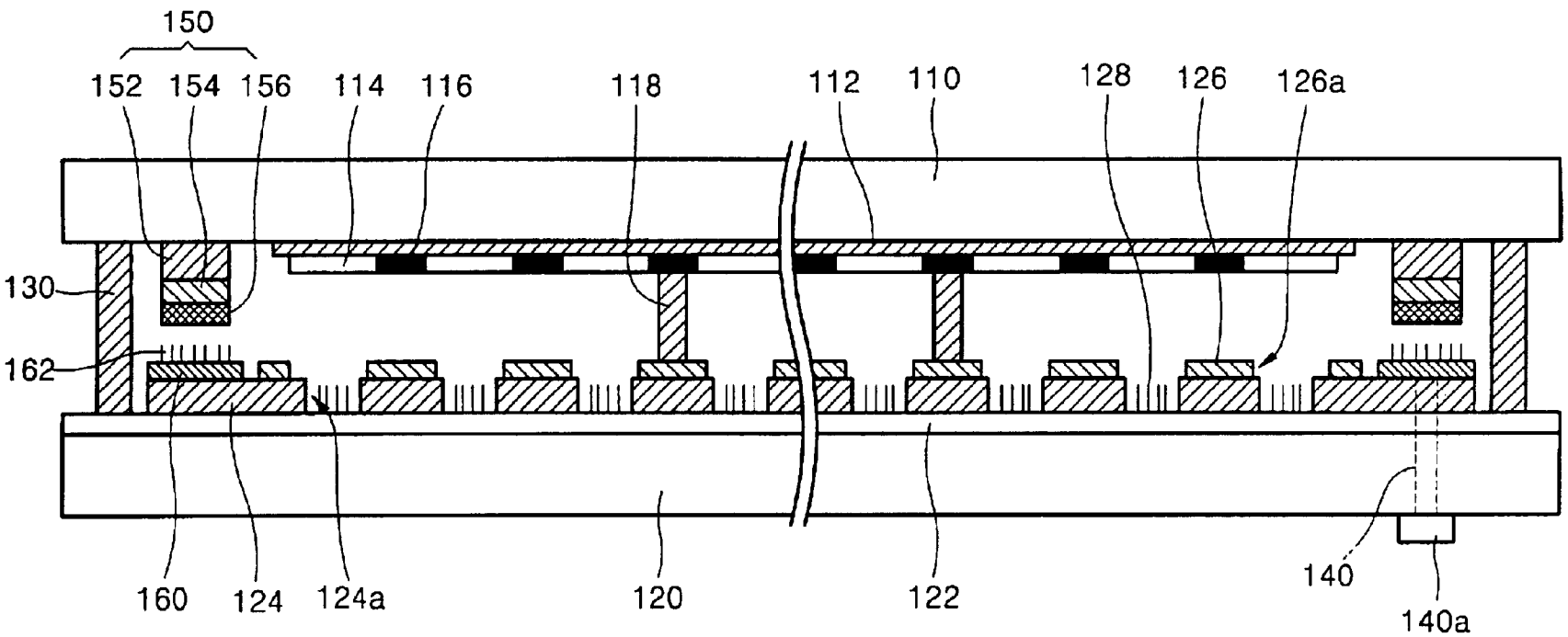
FIG. 3 is a schematic cross-sectional view of a FED according to a preferred embodiment of the present invention.
Figure 4:
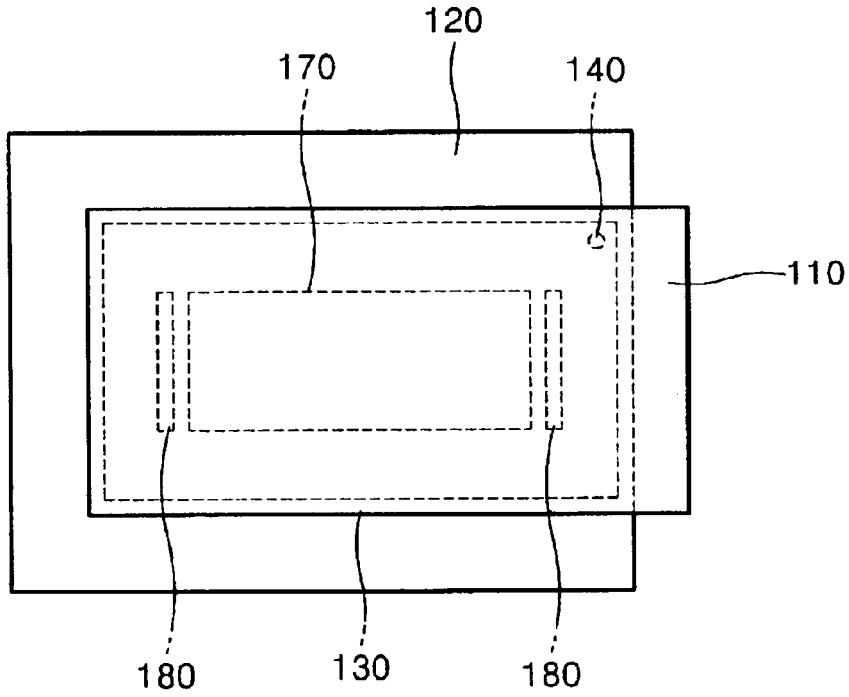
FIG. 4 is a schematic projected top view of FIG. 3.

FIG. 3 is a schematic cross-sectional view of a FED according to a preferred embodiment of the present invention, and FIG. 4 is a schematic projected top view of the FED according to the preferred embodiment of the present invention, and a detailed description of elements that are the same as those of the prior art will be omitted.

The FED according to the preferred embodiment of the present invention includes a front plate 110 and a back plate 120 that are spaced from one another by a gap, an electron-emitting portion that is formed on the back plate 120 in an active display region 170, a light emission-displaying portion that is formed on the front plate 110, and a getter portion 180 that is isolated outwardly from the active display region 170. Cathodes 122 having a striped form are formed on the inside of the back plate 120. A gate insulating layer 124 in which holes 124*a* are formed, is disposed on the cathodes 122. A gate electrode 126 having gates 126*a* corresponding to the holes 124*a* is formed on the gate insulating layer 124. Electron emission sources 128 such as micro tip and carbon nanotube (CNT), are formed on the surface of the cathodes 122 that are exposed at the bottom of the holes 124*a*.

Anodes 112 having a striped electrode or face electrode are formed on the inside of the front plate 110. Phosphor layers 114 having colors corresponding to pixels are coated on the anodes 112, and a black matrix 116 for improving contrast and color impurity is formed among the phosphor layers 114.

A plurality of spacers 118 for maintaining the gap between the front plate 110 and the back plate 120 are positioned between the front plate 110 and the back plate 120, and a sidewall frame 130 for sealing a display panel is positioned at edges between the front plate 110 and the back plate 120. An exhausting path 140 for exhausting an internal gas is positioned at one side of the back plate 120, and a sealing cap 140*a* for sealing the outlet of the exhausting path 140 is formed outside the exhausting path 140.

The getter portion 180, which is a feature of the present invention, is formed as a striped form between the active display region 170 and the sidewall frame 130. The getter portion 180 includes a supporter 152, an getter anode 154, and a getter layer 156 forming a getter stack 150 on the inner surface of the front plate 110, a getter cathode on the inner surface of the back plate 120 to be opposite to the getter anode 154, and electron emission sources for activating a getter 162, which are formed on the cathodes 160 and emits an electron for activating the getter layer 156. The electron emission sources 162 may be formed of carbon nanotube or micro tip.

The getter layer 156 is formed of non-evaporable type zirconium (Zr) particles, and an oxide layer is formed on the surface of the getter layer 156. The getter layer 156 absorbs gas while the oxide layer is stripped from its surface by the electron emission sources 162.

After the getter anode 154 and the getter layer 156 are formed on a substrate in order to get a plurality of supporters 152, the substrate is separated through a dicing process, and thereby the plurality of supporter 152 are acquired. The gap between the getter anode 154 and the getter cathode 160 can be controlled by the height of the supporter 152.

The function of the above structure will be described in detail with reference to drawings.

Firstly, 1~3 kV voltage is applied to both ends of the getter anode 154 and the getter cathode 160, then electrons with high energy are emitted from the electron emission sources 162. The emitted electrons are collided with the surface of the non-evaporable getter (NEG) layer 156, and thereby a protection layer, which is an oxide layer that is formed on the surface of getters is removed. Subsequently, residual gases inside the display are absorbed by the activated getter layers 156. The activation operation of the getter layer 156 is performed when the display is manufactured or the luminance of the display is lowered.

Subsequently, when 1~3 kV voltage is applied between the cathode 122 and the gate electrode 126, electrons are emitted from the front edges of the electron emission sources 128 having strong electric fields, and the emitted electrons are collided at the color phosphor layer 114 on the front plate 112, and thereby, desired image data is displayed on the FED.

Figure 5:
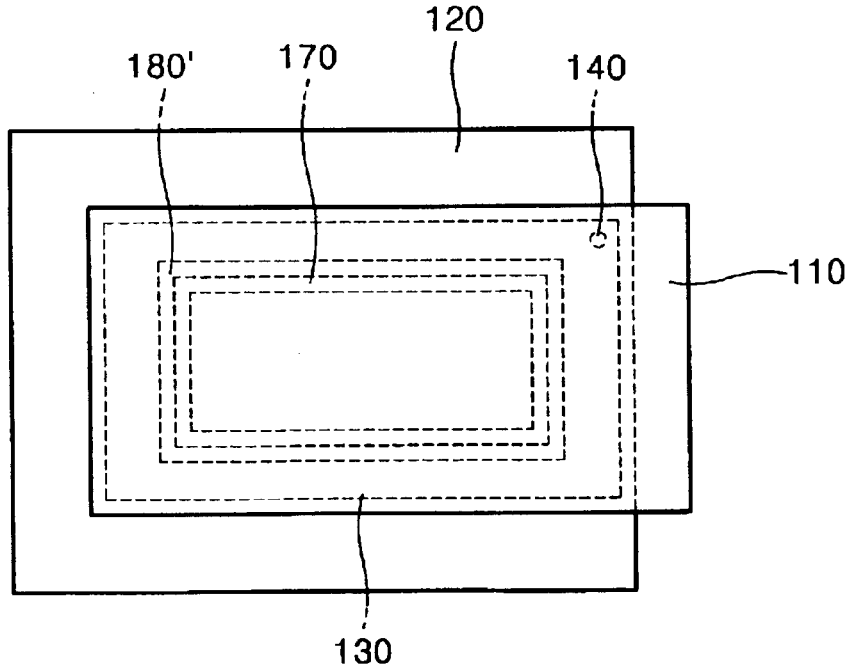
FIG. 5 is a projected top view illustrating a modified example of FIG. 4.

FIG. 5 is a projected top view illustrating a modified example of the FED according to the present invention, and same reference numerals are used in same elements as in the preferred embodiment, and a detail description thereof will be omitted.

Referring to FIG. 5, a getter portion 180' is formed to surround the active display region 170. Likewise, the getter portion 180', which is a feature of the present invention, may be formed in various positions, and the operation of the getter portion 180' is as described above, and thus, a description thereof will be omitted.

The manufacturing process of the FED having the above structure will be described in detail with reference to drawings.

The anode 112 of face electrode, the phosphor layer 114 having colors of red (R), green (G), and blue (B), and the black matrix 116 are formed on a glass plate as the front plate 110, and then, a getter stack 150 is attached outside the active display region 170. The getter stack 150 includes the supporter 152, a getter anode 154, and a non-evaporable getter (NEG) layer which are sequentially stacked. And the getter anode 154 under the getter layer 156 is connected to an external terminal electrode (not shown) that is formed outside vacuum space with a conductive paste.

To manufacture the getter stack 150, firstly, an indium tin oxide (ITO) layer which is a transparent conductive film, is coated on a substrate having the thickness of 400–700 $\mu$m to the thickness of 1800–3000 Å as a face electrode form, by using sputtering equipment. Next, a non-evaporable getter (NEG) layer of which main composition is zirconium (Zr), is uniformly formed to the thickness of 20–100 $\mu$m on the ITO electrode layer.

Subsequently, the substrate on which the getter layer is formed is diced to have the length of 5–10 mm, and thereby a plurality of the getter stack 150 is fabricated.

After that, the getter stack 150 is bonded on the front plate 110 by melting a frit between the getter stack 150 and the front plate 110.

The getter layer 156 is formed through a screen printing method using zirconium (Zr) paste with high viscosity, or is formed by forming zirconium (Zr) on a plate in a solution state with low viscosity containing electric charge materials through an electrophoresis method and by attaching the plate on which Zr is formed, to the getter anode 154.

The zirconium (Zr) paste is acquired as a mixture of a getter material having a main component of zirconium powder with high purity and binder solution that is formed of nitrocellulose and acetate as a viscosity-retentive material. In this case, the zirconium powder is preferably 60–90 weight % in the mixture.

In a case where the getter layer 156 is formed through the screen printing method, the formed getter layer 156 is dried and sintered at a temperature of 380–430° C., and organic materials such as solvent and solute that are contained in the zirconium paste are decomposed, and only getter particles having a main component of zirconium (Zr) are formed on the getter anode 154. Preferably, a thermal process of the getter layer 156 is performed in an inactive gas atmosphere so that a minimum of oxide layer is formed on the surface of the getter material.

Meanwhile, a cathode 122 and a gate insulating layer 124 are formed in regions corresponding to the active display region 170 and the getter stack 150 on the back plate 120 of a glass substrate. Next, a gate electrode 126 is formed on the active display region 170, and a getter cathode 160 is formed on the gate insulating layer 124 corresponding to the getter stack 150.

Next, the gate electrode 126 and the gate insulating layer 124 are etched as a circular hole shape in which electron emission sources 128 are to be formed. The electron emission sources 128 are coated in the hole in a paste state. In such a case, preferably, the electron emission sources 162 are simultaneously formed on the getter cathode 160.

Next, the sidewall glass 130 is disposed at edges between the back plate 120 and the front plate 110, and a frit paste is deposited in an area where the sidewall glass 130 contacts the back plate 120 and the front plate 110, and these are jointed to one another. Subsequently, the contact area is sealed after the frit paste is thermally melted, and the end of the gas path 140 is connected to a heating and exhausting apparatus (not shown), and the heating and exhausting process of the panel is performed so that the inside of the panel is maintained in a high vacuum state. Various residual gases that may be generated sometime inside the display panel are emitted by heating the panel at a temperature of about 320–350° C. and the gases are exhausted during the heating and exhausting process. After the vacuum state inside the panel is lower than or equal to $10^{-5}$ torr, a sealing cap 140*a* is attached to the end of the gas path 140, or the end of the gas path 140 is melted and sealed.

Next, 1~5 kV voltage is applied between the getter anode 154 and the getter cathode, electrons with high energy are emitted from the electron emission sources 162 and are collided at the surface of the non-evaporable getter layer 156, and thereby the getters are activated.

In order to drive the FED that is manufactured through the above method, by applying about 70~100 V voltage between the cathode 122 and the gate electrode 126, and maintaining about 1~3 kV of potential difference between the cathode 122 and the anode 112, electrons emitted from the electron emission sources 128, are passed through a vacuum region, and are collided with the phosphor layer 114 on the anode 112, and thereby light is emitted in a desired portion. Here, the cathode 122 and the gate electrode 126 each have a linear electrode form having a predetermined interval and width, form an X-Y matrix structure in which the cathode 122 and the gate electrode 126 face each other and between which the gate insulating layer 124 is placed, and thus, light is emitted only in a selected region.

As described above, the non-evaporable getter is used in the FED according to the present invention, and thereby, the gas that is generated in the display is easily absorbed, and the FED is maintained in a high vacuum state.

Figure 6:
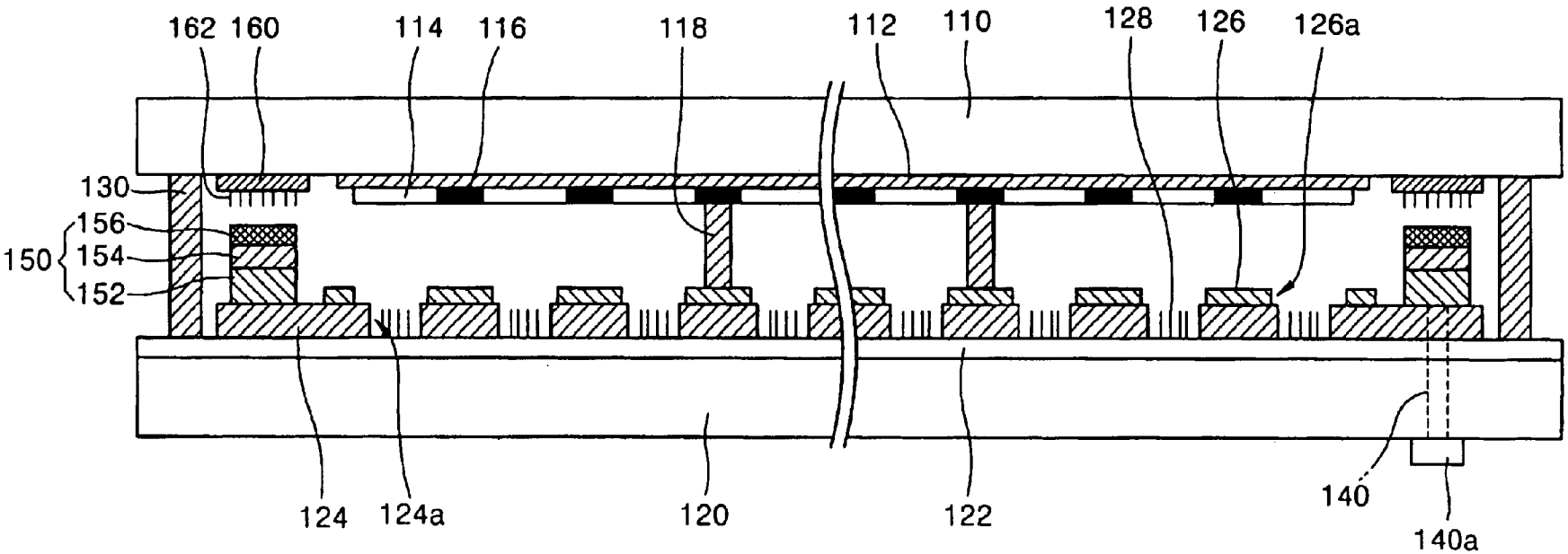
FIG. 6 is a schematic cross-sectional view of a FED according to another preferred embodiment of the present invention.

FIG. 6 is a schematic cross-sectional view of a FED according to another preferred embodiment of the present invention. The FED arrangement shown in FIG. 6 is similar to that shown in FIG. 3, except that the getter portion including the getter anode 154 is provided inside of the back plate 120 and the getter cathode 160 is positioned on the front plate 110 to face the getter anode. As in the arrangement of FIG. 3, the getter layer 156 can be formed on the getter anode 154 and absorbs gas through activation. The getter electron emission source 162 that is formed on the getter cathode 160 emits electrons for activating the getter layer 156. The getter portion shown in FIG. 6 can be arranged to surround the active display region 170, similar to the getter portion 180' shown in FIG. 5. The getter portion can also be formed in various positions on the front or back plates 110, 120. A detailed description of the elements that are the same as those shown in FIG. 3 and described above will be omitted.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A field emission display (FED) comprising:

a front plate and a back plate spaced from one another by a gap, providing an active display region in an internal vacuum space formed therebetween;

an electron-emitting portion being provided in the active display region on the back plate and including a cathode, an electron emission source being formed on the cathode, and a gate electrode for controlling electron emission;

a light emission-displaying portion corresponding to the electron-emitting portion, being provided in the active display region on the front plate and including an anode corresponding to the cathode, and a phosphor layer from which light is emitted by electrons emitted from the electron-emitting portion; and a getter portion including a getter anode that is provided inside of the front plate or the back plate, a getter layer that is formed on the getter anode and absorbs gas through activation, a getter cathode that is positioned on the back plate or the front plate to face the getter anode, and a getter electron emission source that is formed on the getter cathode and emits electrons for activating the getter layer wherein a supporter is provided under the getter anode for positioning the getter anode from the front plate or back plate at a predetermined height.

2. The FED of claim 1, wherein the getter electron emission source for activating the getter layer is a carbon nanotube (CNT) or a micro tip.

3. The FED of claim 1, wherein the getter anode and the getter cathode have a striped form that extends in one direction inside of the corresponding front plate and back plate.

4. The FED of claim 1, wherein the getter portion is isolated outwardly from the active display region.

5. The FED of claim 1, wherein the getter portion is formed to surround the active display region.

6. The FED of claim 1, wherein the getter layer is formed of non-evaporable type zirconium (Zr) particles.

7. The FED of claim 6, wherein the getter layer has a thickness of about 20–100 $\mu$m.

* * * * *